US011073793B2

(12) United States Patent
Lo et al.

(10) Patent No.: US 11,073,793 B2
(45) Date of Patent: Jul. 27, 2021

(54) EXHAUSTS FOR MEDIA DRYING

(71) Applicant: HEWLETT-PACKARD DEVELOPMENT COMPANY, L.P., Spring, TX (US)

(72) Inventors: Kevin Lo, Vancouver, WA (US); Matthew Raisanen, Vancouver, WA (US); Alan Shibata, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/420,042

(22) Filed: May 22, 2019

(65) Prior Publication Data

US 2020/0371471 A1 Nov. 26, 2020

(51) Int. Cl.
*G03G 21/20* (2006.01)
*B41J 29/377* (2006.01)

(52) U.S. Cl.
CPC ..... *G03G 21/206* (2013.01); *B41J 29/377* (2013.01)

(58) Field of Classification Search
CPC ..... G03G 21/20–206; B41J 29/377
See application file for complete search history.

(56) References Cited

U.S. PATENT DOCUMENTS 8,307,949 B2 * 11/2012 von Linsowe ..... F01N 1/083 181/264
9,201,394 B2 * 12/2015 Hiraoka ..... G03G 15/2064
2009/0085997 A1 4/2009 Sakamoto
2010/0188455 A1 7/2010 Shinkawa et al.
2010/0188469 A1 7/2010 Ikegami
2012/0249703 A1 10/2012 Nishimura
2014/0009548 A1 1/2014 Toya et al.
2014/0376950 A1 * 12/2014 Hara ..... G03G 21/206 399/92
2016/0170368 A1 * 6/2016 Ishida ..... G03G 21/1619 399/92
2017/0060084 A1 * 3/2017 Nishikawa ..... G03G 21/206

FOREIGN PATENT DOCUMENTS

JP 04358172 A * 12/1992
JP 09211919 A * 8/1997
JP 10340037 A * 12/1998
JP 2015036783 A * 2/2015

* cited by examiner

*Primary Examiner* — Erika J Villaluna
(74) *Attorney, Agent, or Firm* — HP Inc. Patent Department

(57) ABSTRACT

An example device includes a conveyor to convey a printed medium along a path from a print engine towards a printed media output. The device further includes a housing to hold the conveyor. The housing defines an air intake, an exhaust port, and a conveyor volume to contain the conveyor. The air intake provides air to the conveyor volume to dry the printed medium. The device further includes a tortuous exhaust passage extending from the conveyor volume to the exhaust port to exhaust air from the conveyor volume.

20 Claims, 5 Drawing Sheets

EXHAUSTS FOR MEDIA DRYING

BACKGROUND

Many types of printers deposit ink or other fluid print agent onto print media, such as paper, cardstock, or the like. Ink may be jetted onto a print medium and may dry on the print medium to create imagery, text, or other information.

DETAILED DESCRIPTION

Printers may include components to dry a printed medium. A blower may be provided to blow air over a newly printed sheet to promote the drying of ink before the sheet is output at a print media output (e.g., a paper output tray). Moisture-bearing air that results from the drying process may be removed from the printer via the print medium output. This may cause backpressure in the printer if, for example, the print medium output has a low cross-sectional area. Backpressure may cause humid air to seek unexpected pathways to exit the printer and/or may promote condensation in the printer. Noise generated by the printer due to the blower or air movement may be increased, particularly if the print medium output is large or specifically shaped for paper/media output. In addition, user experience may suffer by having warm and humid air exhausted into an area where printed media is to be manually retrieved.

In examples discussed herein, drying air is exhausted through an exhaust passage that is separate from the printed media outlet. The exhaust passage includes a tortuous or serpentine path that reduces the noise emitted by the printer. A sound reflection plate may be provided to the tortuous path to further muffle noise emission.

The dryer airflow path may run through a conditioner module. The conditioner module may include a conveyor to convey printed media from a print engine to a finisher or output tray. The conveyor may provide for tensioning of printed media under transport and calendaring. The conveyor may be tilted with respect to the horizontal and this may provide for a larger internal volume for air drying.

Figure 1A:
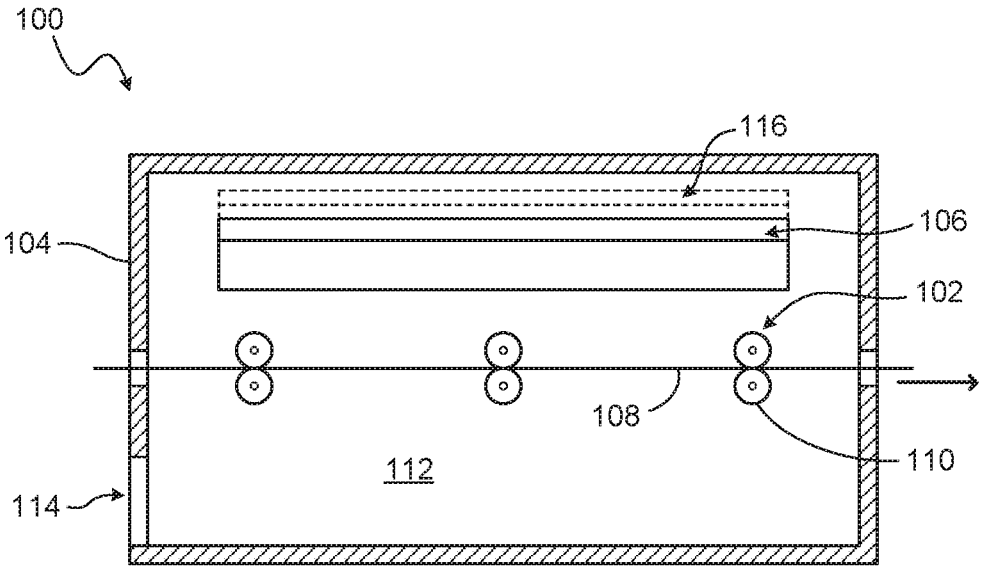
FIG. 1A is a rear cross-sectional view of an example device including a conveyor to convey a printed medium being airdried and a tortuous exhaust passage to exhaust the air.

FIG. 1A shows an example device 100. The device 100 may be included in a printer that deposits a print agent, such as ink, to print media, such as paper. The device 100 may serve to convey and dry printed media. The device 100 may be fed printed media by a print engine. The device may deliver printed media to a finisher or output tray. The device 100 may be a conditioner or conditioner module.

The device 100 includes a conveyor 102, a housing 104 to hold the conveyor 102, and a tortuous exhaust passage 106.

The conveyor 102 is structured convey a printed medium 108 along a path. The path may extend from a print engine towards a printed media output. The conveyor 102 may include rollers 110, such as opposing pairs of rollers 110, to contact the printed medium 108. A driven roller 110 may pull the printed medium 108 through the conveyor 102. Tension in the print medium 108 may be controlled a roller 110, for example, by pulling the printed medium 108 with a leading roller 110 while applying a resistance to rotation at a trailing roller 110. The conveyor 102 may apply tension to the print medium 108 to promote flatness of the print medium 108, as the ink or other print agent dries.

The housing 104 defines a conveyor volume 112 to contain the conveyor 102. The housing 104 may secure the rollers 110, or a component that carries the rollers 110, within the conveyor volume 112. The conveyor volume 112 may be shaped and sized to provide for air flow and humid air capacity. For example, increasing the size of the conveyor volume 112 increases the amount of air that is available to sequester humidity from the print medium 108. In this example, the conveyor volume 112 is larger than the volume occupied by the conveyor 102.

The housing 104 further defines an air intake 114, through which drying air may be provided to the conveyor volume 112 to dry the printed medium 108. The air intake 114 may be provided with air under positive pressure from a blower or similar air mover.

The housing 104 further defines an exhaust port 116 to exhaust air from the device 100. The exhaust port 116 may be positioned relative to the air intake 114 with respect to the shape of the conveyor volume 112 to direct air to flow around the conveyor 102 and thus the print medium 108. For example, the exhaust port 116 may be positioned on a side of the conveyor 102 that is opposite the air intake. The exhaust port 116 may be shaped as an elongate slit.

The tortuous exhaust passage 106 extends from the conveyor volume 112 to the exhaust port 116. The tortuous exhaust passage 106 exhausts air from the conveyor volume 112 to outside the device 100.

Figure 1B:
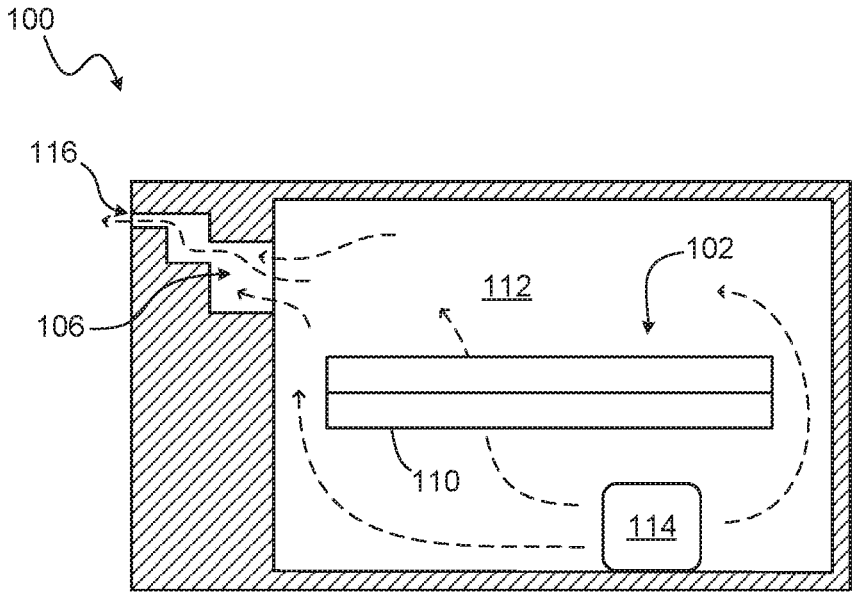
FIG. 1B is a side cross-sectional view of the example device of FIG. 1A.

As shown in FIG. 1B, the tortuous exhaust passage 106 follows an indirect or meandering path from the conveyor volume 112 to the exhaust port 116. Such a tortuous path may include an S-bend.

The tortuous exhaust passage 106 allows air that bears moisture generated by the drying process within the conveyor volume 112 to be removed from the device 100. At the same time, the tortuous exhaust passage 106 reduces sound emitted from the conveyor volume 112 to outside the device 100. Sound generated within the conveyor volume 112, or communicated into the conveyor volume 112 by another component of the device 100, is reflected within the tortuous exhaust passage 106. It is contemplated that sound waves undergo negative interference or otherwise lose energy in the tortuous exhaust passage 106, thereby attenuating sound energy that exits the exhaust port 116. The tortuous exhaust passage 106 is shaped and sized to promote air flow so that backpressure in the conveyor volume 112 is reduced. For example, the tortuous exhaust passage 106 illustrated includes several bends and gradually reduces in cross-sectional area in the direction of air flow. This may serve to reduce sound energy emitted via the exhaust port 116, which could be perceived as noise by people near the device 100, while allowing sufficient air flow to reduce backpressure and reduce the risk of condensation occurring in the conveyor volume 112.

Figure 2A:
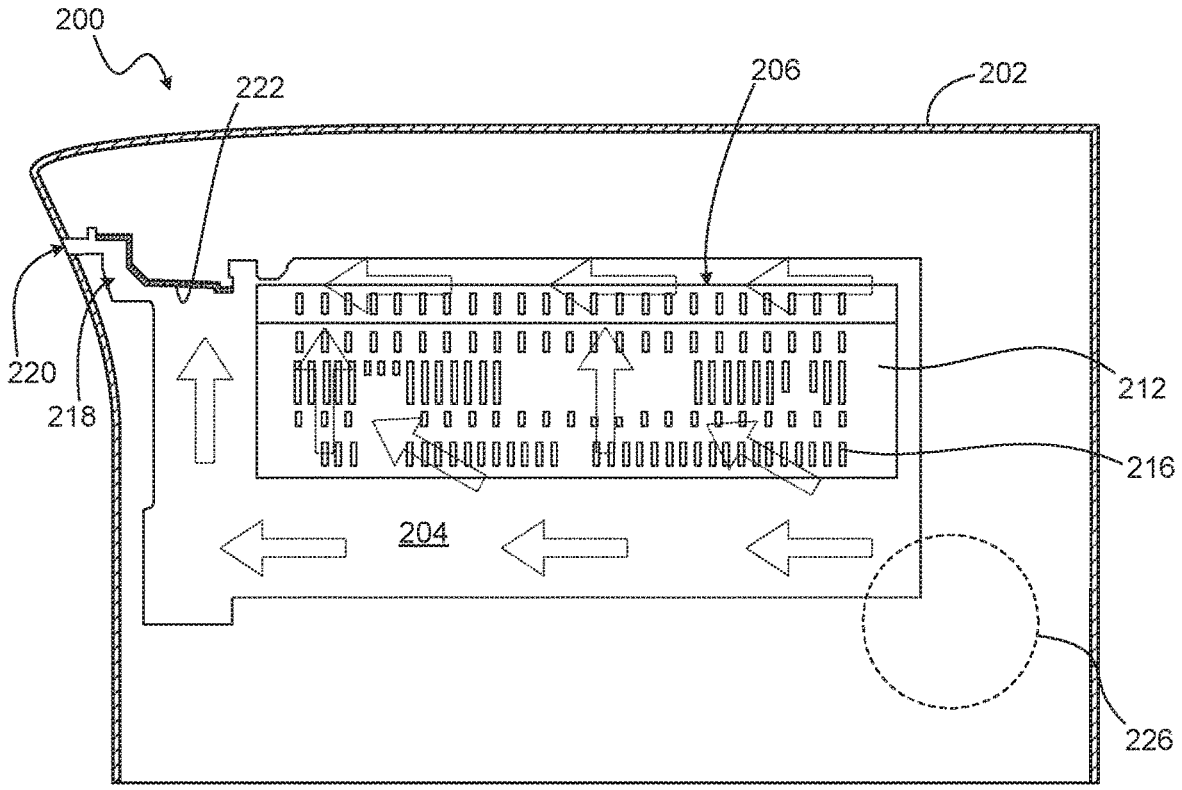
FIG. 2A is a side cross-sectional view of an example device including a tilted conveyor to convey a printed medium being airdried and a tortuous exhaust passage to exhaust the air.

FIG. 2A shows another example device 200. The device 200 may be included in a printer and may be a conditioner or conditioner module. Feature and aspects of the other devices described herein, such as the device 100, may be used with the device 200 and redundant description is omitted for sake of clarity.

The device 200 includes a housing 202 that defines an internal conveyor volume 204. The device 200 further includes a conveyor 206 disposed within the conveyor volume 204.

Figure 2B:
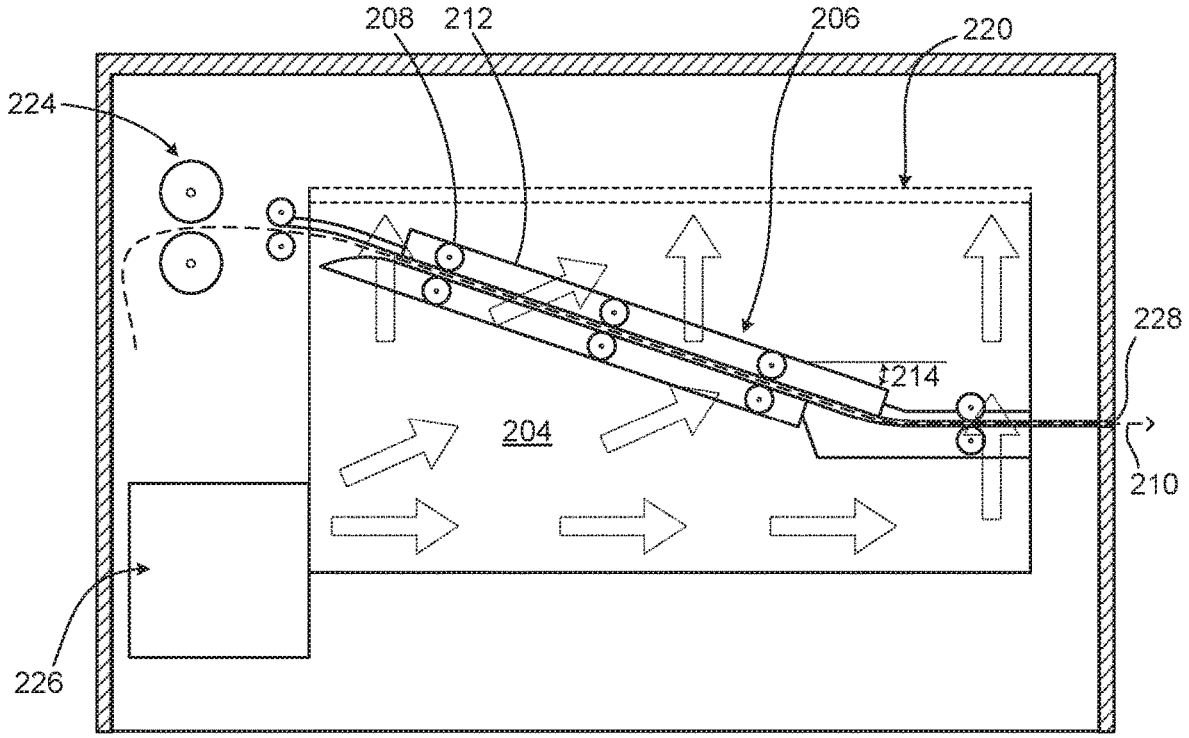
FIG. 2B is a front cross-sectional view of the example device of FIG. 2A.

As shown in FIG. 2B, the conveyor 206 may include rollers 208 to convey print media along a conveyor path 210. The rollers 208 may be assembled with a bridge guide 212 to constrain or guide the print media on the path defined by the conveyor 206. The bridge guide 212 may include a body such as a plate. The bridge guide 212 may be tilted at an angle 214 with respect to the horizontal.

The angle 214 of the bridge guide 212 may be selected to extend the straight length of the conveyor path 210 as compared to the bridge guide 212 being horizontal. The extended conveyor path 210 may allow for greater contact of print media with drying air in the conveyor volume 204. In addition, the extended straight length may allow for a larger sheet size to be pulled flat as the sheet is being dried. The angle 214 may be selected to increase the straight length of the conveyor path 210 at the cost of increased vertical dimension of the conveyor volume 204. Examples of angles include 15 degrees, 20 degrees, 25 degrees, 30 degrees, and 35 degrees. In this example, the angle 214 is about 25 degrees, meaning that the straight length of the conveyor path 210 is about 10% longer than if the bridge guide 212 were horizontal. In various examples, the angle 214 may be selected to with regard to the tradeoff between overall size of the device 200, increased drying volume 204, and increased straight length of the conveyor path 210.

With reference back to FIG. 2A, the bridge guide 212 may include openings 216 to provide for air flow though the conveyor 206 and in and around the conveyor path 210. The openings 216 allow for drying air to contact the print media being conveyed and allow for flow or air around the print media and components of the conveyor 206 to promote drying and reduce risk of condensation. Any number of openings 216 may be provided in the bridge guide 212. Openings 216 may be distributed approximate evenly to promote even drying. Openings 216 may be slots that are molded, cut, or stamped into a plate of the bridge guide 212.

The device 200 includes a tortuous exhaust passage 218 positioned at an edge of the conveyor volume 204. The tortuous exhaust passage 218 follows an indirect or meandering path from the conveyor volume 204 to an exhaust port 220. Such a tortuous path may include an S-bend. The exhaust port 220 may be a horizontal elongate slit.

The device 200 may further include a sound reflection plate 222 positioned within the tortuous exhaust passage 218. The sound reflection plate 222 may be positioned on a downstream surface of the tortuous exhaust passage 218. The sound reflection plate 222 may include flat surfaces angled with respect to one another to define the downstream surface of the tortuous exhaust passage 218. The size, shapes, and relative angles of the surfaces of the sound reflection plate 222 may be selected to reflect soundwaves to cause destructive interference and/or reflection back into the conveyor volume 204. A downstream surface may be considered a surface onto which airflow impinges and which consequently changes a direction of airflow. Airflow may impinge on a downstream surface at various angles.

The sound reflection plate 222 may be made of metal or other material that reflects a significant amount of sound. The sound reflection plate 222 include contiguous locally flat materials without openings, raised features, or similar. The sound reflection plate 222 may be shaped to reflect sound in predetermined directions. In other examples, a plate 222 is provided to absorb, disperse, or cancel sound with or without reflecting sound. For instance, a plate 222 may include baffles, perforations, ripples, peaks and valleys, or similar structure shaped to absorb, disperse, or cancel sound not necessarily by reflection.

In operation, printed media enters the conveyor volume 204 from, for example, an iron 224 that may include a set of rollers to press and heat the printed media. The conveyor 206 conveys the printed media along then conveyor path 210 and through the conveyor volume 204. At the same time, air is blown into the conveyor volume 204 from, for example, a blower 226. Air flows through the conveyor volume 204 (illustrated by arrows in FIGS. 2A and 2B), around the conveyor 206, through the openings 216 in the bridge guide 212, and around the printed media conveyed along the conveyor path 210 towards a printed media outlet 228 which is separate from the exhaust port 220. In this manner, the printed media is dried. The resulting moisture-bearing air is exhausted through exhaust port 220 via the tortuous exhaust passage 218. Sound generated by the blower 226, the conveyor 206, and by air movement travels the tortuous exhaust passage 218 and undergoes attenuation. A such, printed media may be conveyed and dried quickly with a relatively large volume of drying air, while reducing noise emissions.

Figure 3:
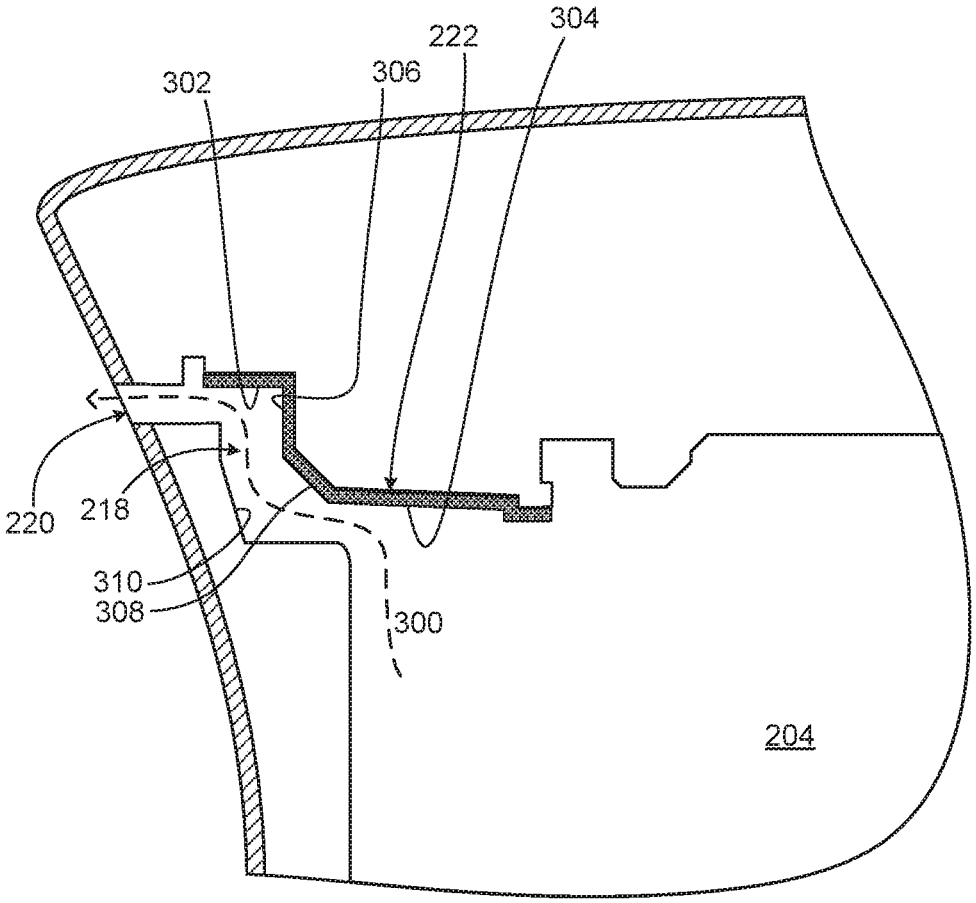
FIG. 3 is a close-up side cross-sectional view of the example tortuous exhaust passage and sound reflection plate of FIGS. 2A and 2B.

As shown in FIG. 3, the tortuous exhaust passage 218 may have a profile that includes an S-bend, so that exhausted air follows an indirect, approximately S-shaped exhaust path 300. The tortuous exhaust passage 218 may be shaped to give the exhaust path 300 two or three approximately right-angle (90 degree) bends. The shape of the tortuous exhaust passage 218 reduces sound output while allowing suitable air flow.

To further reduce sound output, the sound reflection plate 222 may be shaped to define a downstream boundary of the tortuous exhaust passage 218. A downstream boundary may include a downstream surface. In various examples, a downstream boundary includes multiple downstream surfaces onto which airflow may impinge and which may direct and guide airflow. In this example, the sound reflection plate 222 includes an approximately horizontal exit surface 302 adjacent the exhaust port 220. At the other extent, closest to the conveyor volume 204, the sound reflection plate 222 includes a larger entrance surface 304 that may be slightly angled off the horizontal to funnel air into the tortuous exhaust passage 218. The sound reflection plate 222 may further include a vertical surface 306 adjacent the horizontal exit surface 302, and further an angled surface 308 between the vertical surface 306 and the entrance surface 304. The angled surface 308 may be angled with respect to the horizontal at about 45 degrees. Other example angles include 35 degrees, 40 degrees, 50 degrees, and 55 degrees. Opposite the angled surface 308, tortuous exhaust passage 218 may include an opposing surface 310 that is at a greater angle to the horizontal, so as to define a funnel-like shape with the angled surface 308. That is, the angled surface 308 and the opposing surface 310 converge along the length of the exhaust path 300 in the direction of airflow towards the exhaust port 220.

An example tortuous exhaust passage 218 with an example sound reflection plate 222, both with geometry generally as described and illustrated herein, was found to significantly reduce noise emissions of a printer. Significant sound reduction was realized even when the opposing surface 310 was not provided with structure to absorb, disperse, or cancel sound. That said, in various examples, the opposing surface 310 may be provided with structure (e.g., baffles, perforations, etc., discussed elsewhere herein) to absorb, disperse, or cancel sound.

Figure 4:
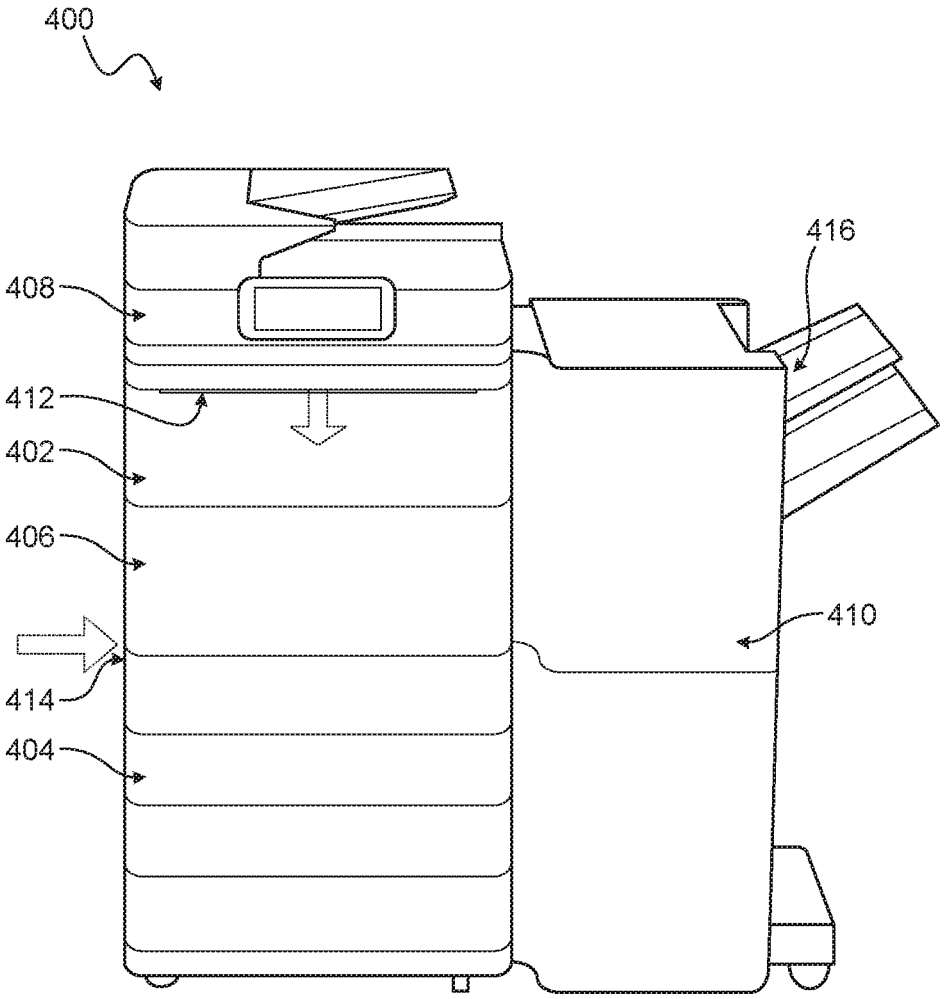
FIG. 4 is perspective view of an example printer including an example conditioner with a horizontal exhaust slit.

FIG. 4 shows an example printer 400. Feature and aspects of the other devices described herein may be used with the example printer 400 and redundant description is omitted for sake of clarity.

The printer 400 includes a conditioner 402, which may also be referred to as a conditioner module. The printer 400 may have a modular construction with various functional modules vertically stacked or otherwise mutually connected.

The printer 400 may further include a media source module 404, such as a paper cart or paper tray, and a print engine 406 stacked on top of the media source module 404. The conditioner 402 may be stacked onto the print engine 406. Above the conditioner 402 may be a scanner/automatic document feeder (ADF) module 408, which may also carry a user interface, such as a touchscreen, buttons, and the like. A finisher 410 may be coupled to the side of the conditioner 402 to receive output printed media from the conditioner 402.

The conditioner 402 may include an exhaust port 412 that is shaped as a horizontal slit. The exhaust port 412 may be positioned towards the top of the conditioner adjacent the scanner/ADF module 408 or a spacer that is between the conditioner 402 scanner/ADF module 408.

Examples of conditioners have been discussed above, as devices 100, 200, which include exhaust ports 116, 220 that may be used as the exhaust port 412.

The conditioner 402 may include a conveyor, such as a conveyor 102, 206, discussed above. The conditioner 402 may be fed printed media by the print engine 406. The conditioner 402 may output conditioned printed media to the finisher 410.

The printer 400 may include an air intake 414 towards the lower end of the conditioner 402, such as near the print engine 406.

In operation, humid air, resulting from drying printed media, is exhausted through the separate exhaust port 412 and not at a printed media outlet 416 at the finisher 410.

Figure 5:
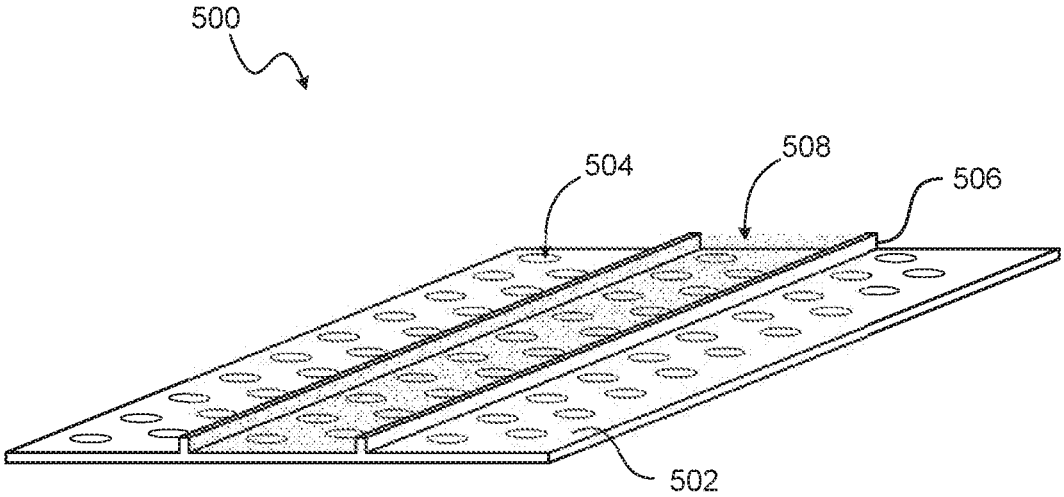
FIG. 5 is a perspective view of an example plate to hold sound absorbing material, where the plate is positionable in an exhaust passage.

FIG. 5 shows an example plate 500. The plate 500 includes example structure that may be used with a sound reflection plate or a bridge guide plate discussed herein. The plate 500 is shown as generally flat for sake of explanation. In various examples, the plate 500 may be bent or formed to take any suitable shape, such as the angled shape of the sound reflection plate 222 as shown in FIG. 3.

The plate 500 may include flat regions 502 and openings 504 distributed in the flat regions 502. The openings 504 may fully penetrate though the plate 500. The openings 504 may include perforations, holes, gaps, slots, or similar. The openings 504 may be molded, cut, or stamped into the plate 500.

The plate 500 may further include ribs 506 or other raised structure. The ribs 506 may be linear, as shown, or may have another shape, such as curved.

The material of the flat regions 502 without openings 504 may provide sound reflection. The ribs 506 may also provide for sound reflection. The openings 504 may allow for sound to enter/exit a volume defined by the flat regions 502 and ribs 506. Such volume may be filled with material 508, such as mesh (e.g., glass cloth, metal screen), absorbent material (e.g., fiberglass), or similar. Mesh may overlie the absorbent material to secure the absorbent material in the volume. The absorbent material may serve to dampen sound.

In view of the above it should be apparent that a tortuous exhaust passage that is separate from a printed media outlet may be used to exhaust humid air, which may result from the drying printed media. The tortuous exhaust passage may reduce noise output by a device, such as a conditioner or printer, while allowing sufficient exhaust air flow. Further, a sound reflection plate may be provided to the tortuous exhaust passage to further reduce noise. In addition, the pressure drop due to the tortuous exhaust passage may be insufficient to reduce air flow to a degree that causes significant condensation in the device.

In the above, it should be noted that reference orientations, such as horizontal and vertical, and directions, such as up, down, left, and right, are illustrative and not intended to be limiting. In addition, the indefinite and definite articles, e.g., "a" and "the," are intended to denote single or plural components, unless otherwise mentioned.

It should be recognized that features and aspects of the various examples provided above can be combined into further examples that also fall within the scope of the present disclosure. In addition, the figures are not to scale and may have size and shape exaggerated for illustrative purposes.

The invention claimed is:

1. A device comprising:

a conveyor to convey a printed medium along a path from a print engine towards a printed media output;

a housing to hold the conveyor, the housing defining an air intake, an exhaust port, and a conveyor volume to contain the conveyor, the air intake to provide air to the conveyor volume to dry the printed medium; and a tortuous exhaust passage extending from the conveyor volume to the exhaust port to exhaust air from the conveyor volume, wherein the tortuous exhaust passage includes a funnel shape defined by opposing surfaces that converge in a direction of exhaust air flow, wherein the funnel shape is positioned between two narrower portions of the tortuous exhaust passage.

2. The device of claim 1, wherein the tortuous exhaust passage includes an S-bend.

3. The device of claim 1, further comprising a sound reflection plate positioned at a downstream surface of the tortuous exhaust passage, wherein the downstream surface is one of the opposing surfaces that define the funnel shape of the tortuous exhaust passage.

4. The device of claim 3, wherein the sound reflection plate is shaped to define a boundary of the tortuous exhaust passage.

5. The device of claim 1, wherein the exhaust port comprises an elongate slit.

6. The device of claim 1, wherein the conveyor comprises a bridge guide that includes openings to provide air flow around the printed medium.

7. The device of claim 1, further comprising a printed media outlet to output the printed medium from the device, the tortuous exhaust passage being separate from the printed media outlet.

8. The device of claim 1, further comprising a conditioner that includes the conveyor, the conditioner to apply tension to the printed medium during drying.

9. The device of claim 1, further comprising a plate positioned at a downstream surface of the tortuous exhaust passage to absorb sound.

10. A device comprising:

a conditioner to convey a printed medium received from a print engine towards a printed media output, the conditioner including a volume to contain air to dry the printed medium;

an exhaust port to exhaust the air from the volume within the conditioner; and an exhaust passage between the volume and the exhaust port, the exhaust passage defining an indirect path from the volume to the exhaust port to attenuate sound emitted via the exhaust port, wherein the exhaust passage includes a funnel shape defined by opposing surfaces that converge in a direction of exhaust air flow, wherein the funnel shape is positioned between two narrower portions of the exhaust passage.

11. The device of claim 10, further comprising a sound reflection plate positioned at a downstream surface of the exhaust passage, wherein the downstream surface on which the sound reflection plate is positioned is one of the opposing surfaces that define the funnel shape of the tortuous exhaust passage, wherein the sound reflection plate is shaped to cause destructive interference to attenuate the sound.

12. The device of claim 10, wherein the exhaust port comprises an elongate slit.

13. The device of claim 10, wherein the conditioner comprises a bridge guide that includes openings to provide air flow around the printed medium.

14. The device of claim 10, further comprising a plate positioned at a downstream surface of the exhaust passage, the plate includes openings to a volume that includes material to absorb sound.

15. A printer comprising:

a print engine;

a conditioner to receive printed media from the print engine, the conditioner including a conveyor to convey a printed medium;

an exhaust port to exhaust air from within the conditioner; and a tortuous exhaust passage extending from the conditioner to the exhaust port, the tortuous exhaust passage being separate from a printed media outlet, wherein the tortuous exhaust passage includes a funnel shape defined by opposing surfaces that converge in a direction of exhaust air flow, wherein the funnel shape is positioned between two narrower portions of the tortuous exhaust passage.

16. The printer of claim 15, wherein the conditioner includes a bridge guide that is tilted with respect to a horizontal, wherein the bridge guide includes openings to provide air flow around the printed medium.

17. The printer of claim 15, wherein the exhaust port comprises an elongated slit.

18. The printer of claim 15, wherein the tortuous exhaust passage includes a plate positioned at a downstream surface of the tortuous exhaust passage, wherein the downstream surface is one of the opposing surfaces that define the funnel shape of the tortuous exhaust passage.

19. The printer of claim 18, wherein the plate defines a volume to hold material to absorb sound.

20. The printer of claim 18, wherein the plate includes a contiguous flat surface to reflect sound.

* * * * *